US008614388B2

(12) United States Patent
Little et al.

(10) Patent No.: US 8,614,388 B2
(45) Date of Patent: Dec. 24, 2013

(54) SYSTEM AND METHOD FOR GENERATING CUSTOMIZED CHORDS

(75) Inventors: Alexander Harry Little, Woodside, CA (US); Eli T. Manjarrez, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 74 days.

(21) Appl. No.: 13/286,145

(22) Filed: Oct. 31, 2011

(65) Prior Publication Data

US 2013/0104725 A1 May 2, 2013

(51) Int. Cl.
*G10H 1/38* (2006.01)

(52) U.S. Cl.
USPC ..... 84/613; 84/609; 84/615; 84/637; 84/649; 84/650; 84/669

(58) Field of Classification Search
None
See application file for complete search history.

(56) References Cited

U.S. PATENT DOCUMENTS 8,003,874 B2 * 8/2011 Asakura et al. ..... 84/613
8,035,020 B2 * 10/2011 Taub et al. ..... 84/600
8,338,686 B2 * 12/2012 Mann et al. ..... 84/609
8,378,194 B2 * 2/2013 Daisy ..... 84/477 R
2010/0192755 A1 * 8/2010 Morris et al. ..... 84/637
2010/0294112 A1 * 11/2010 Asakura et al. ..... 84/613
2011/0011246 A1 * 1/2011 Buskies et al. ..... 84/613
2011/0023688 A1 * 2/2011 Daisy ..... 84/483.1
2012/0160079 A1 * 6/2012 Little et al. ..... 84/613
2012/0192701 A1 * 8/2012 Watanabe et al. ..... 84/622
2012/0312145 A1 * 12/2012 Kellett et al. ..... 84/613
2013/0111346 A1 * 5/2013 Little ..... 715/716

* cited by examiner

*Primary Examiner* — Marlon Fletcher
(74) *Attorney, Agent, or Firm* — Kilpatrick Townsend & Stockton LLP

(57) ABSTRACT

Disclosed herein are systems, methods, and non-transitory computer-readable storage media for generating customized chords. An exemplary method includes providing a storage medium, including a database storing data corresponding to a plurality of predefined chords to be played by the virtual instrument. The method then includes receiving a plurality of user inputs that enable a user to select a desired custom chord other than a predefined chord stored in the database, the user inputs being displayed on a display of said device. The method further includes creating the desired chord from the predefined chord data stored in the database in accordance with a predefined algorithm, and causing data corresponding to the created custom chord to be stored by the device such that the virtual instrument is able to play the created desired chord.

22 Claims, 8 Drawing Sheets

SYSTEM AND METHOD FOR GENERATING CUSTOMIZED CHORDS

BACKGROUND

1. Technical Field

The disclosed technology relates generally to virtual musical instruments.

2. Introduction

Virtual musical instruments, such as MIDI-based or software-based keyboards, guitars, strings, or horn ensembles can include limited predefined chords that allow a novice user to quickly create music. In one example, the chords can allow a user to play individual notes within the predefined chords, such as individual notes of a predefined chord for a virtual piano or virtual guitar. In another example, a user input can trigger all notes of a predefined chord in a manner such as a guitar strum, a piano chord, or in a rhythmic pattern. In these examples, each predefined chord can have multiple variations for these uses.

With a limited number of predefined chords, a device can store all needed variations for each chord. However, users may desire to customize or create entirely new chords for a virtual musical instrument. In such an environment, storing variations for all possible customized chords causes exponential growth of needed memory amongst other problems. Therefore, a need exists to generate customized chords according to user's input.

SUMMARY

Disclosed are systems, methods, and non-transitory computer-readable storage media for generating customized chords. An exemplary method includes providing a storage medium, including a database storing data corresponding to a plurality of predefined chords to be played by a virtual instrument. The method further includes receiving a plurality of user inputs that enable a user to select a desired custom chord other than a predefined chord stored in the database, the user inputs being displayed on a display of the device. The method then includes creating the desired chord from the predefined chord data stored in the database in accordance with a predefined algorithm, and causing data corresponding to the created custom chord to be stored by the device such that the virtual instrument is able to play the created desired chord.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The present disclosure addresses the need in the art for generating custom chords and variations for a virtual music instrument. A system, method and non-transitory computer-readable media are disclosed which generate customized chords based on a user's input. A brief introductory description of a basic general purpose system or computing device in FIG. 1 which can be employed to practice the concepts is disclosed herein. A more detailed description of systems, methods, and non-transitory computer readable mediums that generate customized chords and associated variations will then follow.

Figure 1:
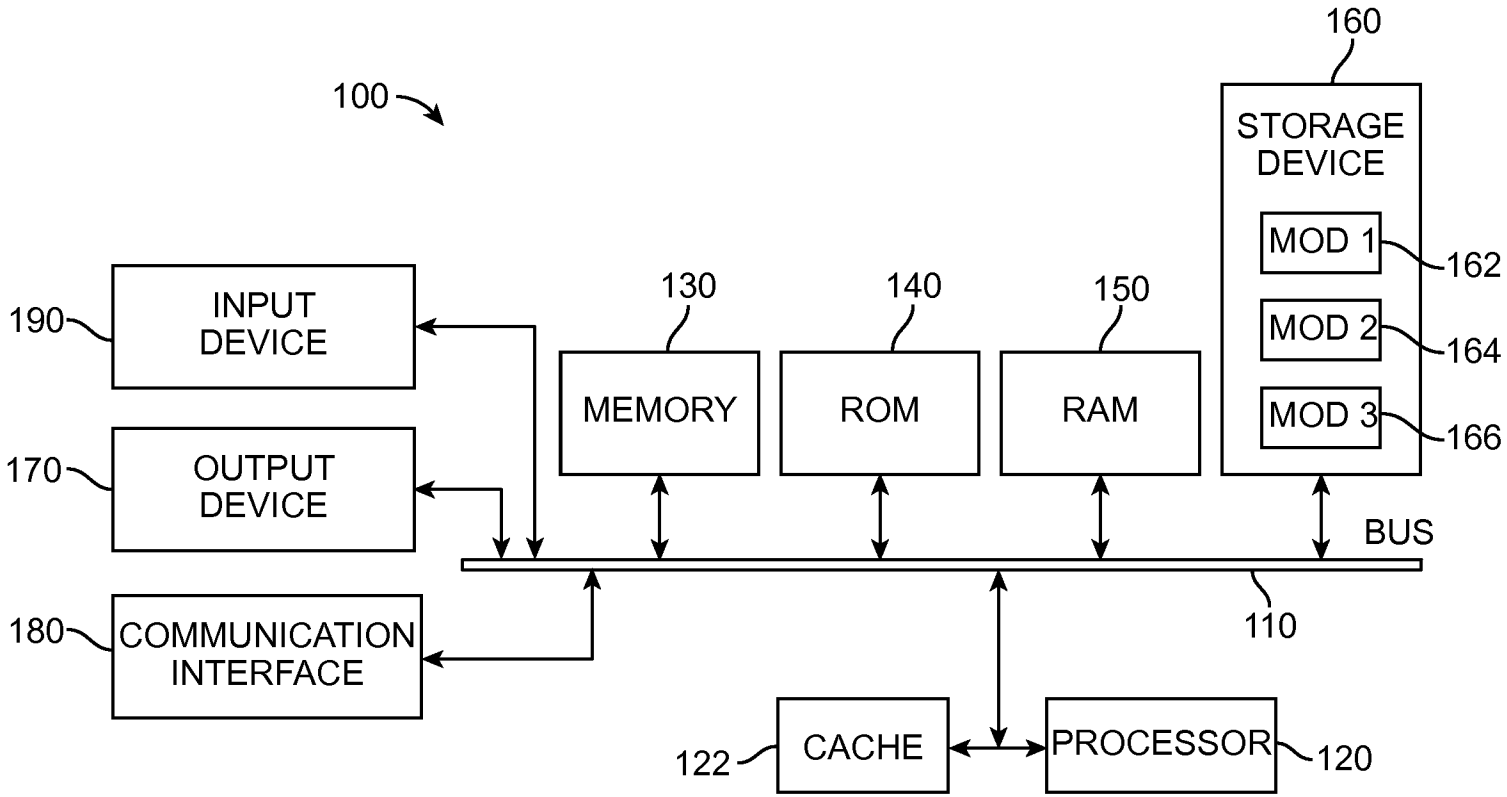
FIG. 1 illustrates an example system embodiment.

The disclosure now turns to FIG. 1.

With reference to FIG. 1, an exemplary system 100 includes a general-purpose computing device 100, including a processing unit (CPU or processor) 120 and a system bus 110 that couples various system components including the system memory 130 such as read only memory (ROM) 140 and random access memory (RAM) 150 to the processor 120. The system 100 can include a cache 122 of high speed memory connected directly with, in close proximity to, or integrated as part of the processor 120. The system 100 copies data from the memory 130 and/or the storage device 160 to the cache 122 for quick access by the processor 120. In this way, the cache provides a performance boost that avoids processor 120 delays while waiting for data. These and other modules can control or be configured to control the processor 120 to perform various actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output system (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. The storage device 160 is connected to the system bus 110 by a drive interface. The drives and the associated computer readable storage media provide nonvolatile storage of computer readable instructions, data structures, program modules and other data for the computing device 100. In one aspect, a hardware module that performs a particular function includes the software component stored in a non-transitory computer-readable medium in connection with the necessary hardware components, such as the processor 120, bus 110, display 170, and so forth, to carry out the function. The basic components are known to those of skill in the art and appropriate variations are contemplated depending on the type of device, such as whether the device 100 is a small, handheld computing device, a desktop computer, or a computer server.

Although the exemplary embodiment described herein can employ the hard disk 160, it should be appreciated by those skilled in the art that other types of computer readable media which can store data that are accessible by a computer, such as magnetic cassettes, flash memory cards, digital versatile disks, cartridges, random access memories (RAMs) 150, read only memory (ROM) 140, a cable or wireless signal containing a bit stream and the like, may also be used in the exemplary operating environment. Non-transitory computer-readable storage media expressly exclude media such as energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations discussed below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited non-transitory computer-readable storage media. Such logical operations can be implemented as modules configured to control the processor 120 to perform particular functions according to the programming of the module. For example, FIG. 1 illustrates three modules Mod 1 162, Mod 2 164 and Mod 3 166 which are modules configured to control the processor 120. These modules may be stored on the storage device 160 and loaded into RAM 150 or memory 130 at runtime or may be stored as would be known in the art in other computer-readable memory locations.

Figure 2:
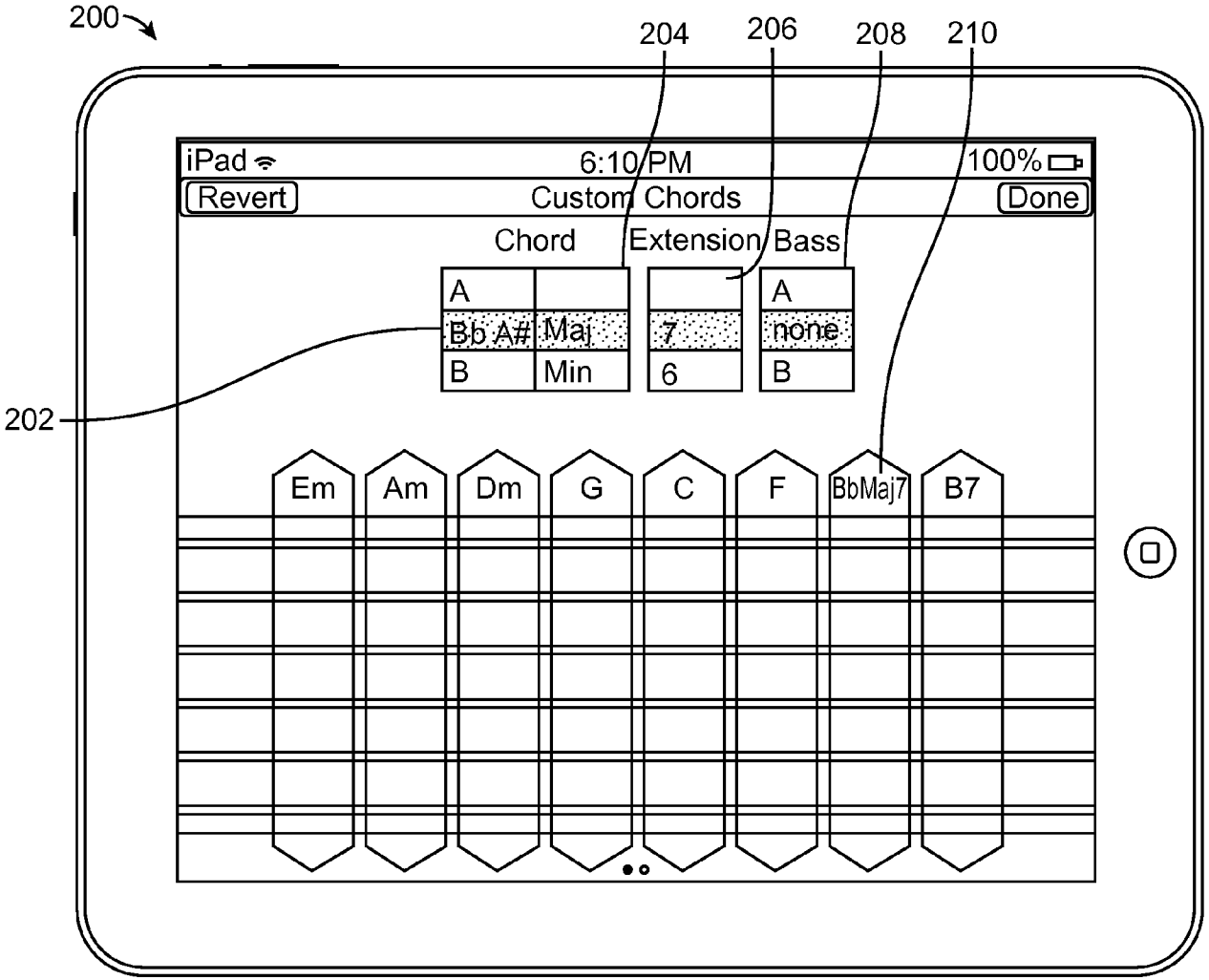
FIG. 2 illustrates a device including a graphical user interface for entering a desired customized chord and a graphical user interface for enabling a user to play chords of a displayed virtual guitar instrument including the customized chord.

Having disclosed some components of a computing system, the disclosure now turns to FIG. 2, which illustrates a device including a graphical user interface for entering a desired customized chord and a graphical user interface for enabling a user to play chords of a displayed virtual guitar instrument including the customized chord. As shown, device 200 is a portable electronic device capable of accepting touch inputs on its touchscreen display. A processor of device 200 is causing the execution and display of a virtual guitar instrument. The virtual guitar instrument includes eight displayed chords. In one example, upon receiving a user input on the touchscreen, an individual note of a displayed chord can be output. In other examples, upon receiving a user input an entire chord (all notes) can be output in a strum manner or according to a rhythmic pattern. These variations are illustrative and not limiting.

As shown in FIG. 2, a user can customize the seventh displayed chord 210 by entering data into fields 202, 204, 206, and 208. As shown in FIG. 2, the input fields 202, 204, 206, and 208 can be displayed in a rotational graphical user interface and allow a user to input a customized chord. In some examples, multiple fields do not require an input for a customized chord to be generated. Input field 202 allows a user to input a desired root note. Input field 204 allows a user to input a type/gender. Input field 206 allows a user to input a desired extension and input field 208 allows a user to input a desired alternate bass note. The rotational graphical input of FIG. 2 has received inputs to indicate a desired customized chord of BbMaj7 in the seventh displayed chord 210. Other user interfaces include a speech user interface where a user can input a desired chord by speaking into a microphone. This speech input can include a root note and gender and optionally any desired extension and/or alternate bass note. The speech user interface can also include a capability to verify a received chord to the user, or to communicate a variety of choices to a user for an ambiguous input.

Figure 3:
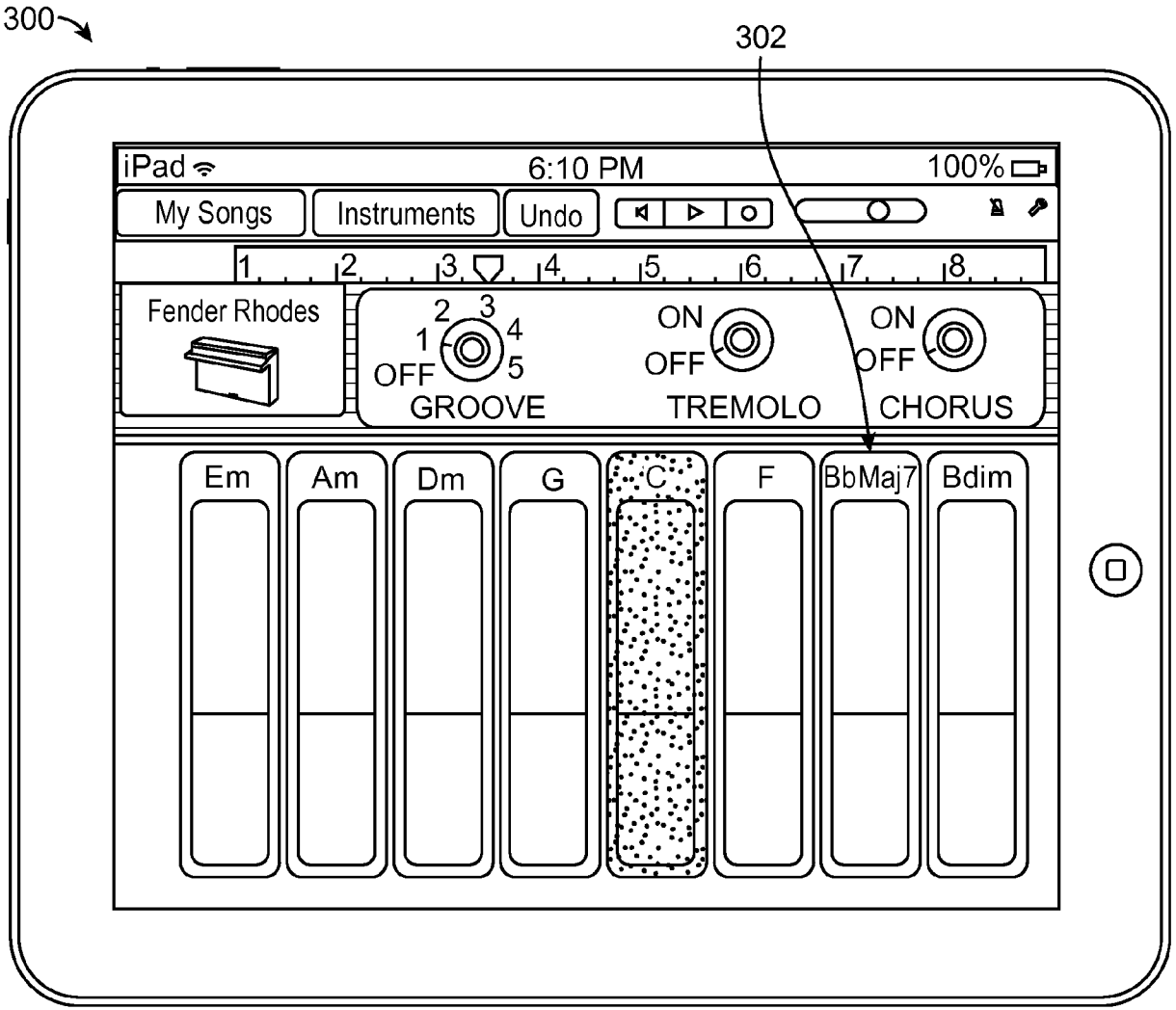
FIG. 3 illustrates a virtual electric piano instrument including a customized chord amongst a set of displayed chords.

FIG. 3 illustrates a virtual electric piano instrument including a customized chord amongst a set of displayed chords. As shown in FIG. 3, wireless electronic device 300, which includes a touchscreen, is executing and displaying a virtual electric piano instrument program. The virtual electric piano instrument includes 8 chords that a user can interact with. In FIG. 3 a user has input data to generate a custom BbMaj7 chord and associated variations including rhythmic patterns in a seventh chord position 302.

Figure 4:
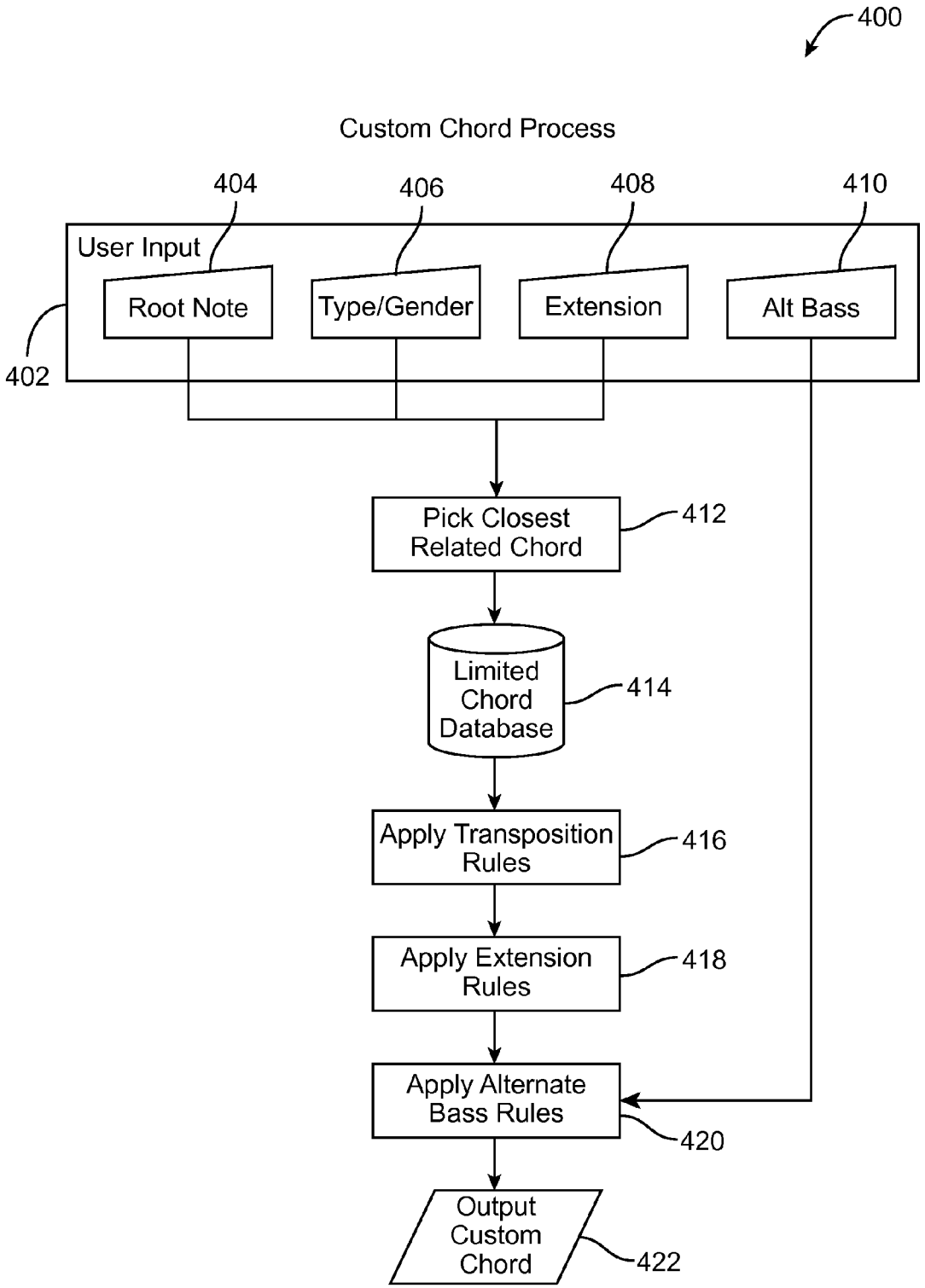
FIG. 4 illustrates a method for generating a customized chord based on limited chords available in a database.

FIG. 4 illustrates a method 400 for generating a customized chord based on limited chords available in a database. The method of FIG. 4 begins at step 402, which accepts a user input. The user input 402 can include up to four pieces of information including root note 404, type/gender 406, extension 408, and alternate bass 410. Although an input with four fields is displayed, a user input with less than four inputs can be acceptable for the method to proceed past step 402 for generating a custom chord. The steps shown in FIG. 4 are only illustrative as one example, and the sequence of steps and steps required to generate a customized chord can vary.

Once a user input in step 402 is received, the method can proceed to step 412, which includes picking a closest related chord in a limited chord database 414. In one example, picking a closest related chord can include selecting a chord with a root note that is a least number of half steps away from the user input root note 404. In a second example, picking a closest related chord can include selecting a chord with an equivalent type/gender as user input type/gender 406. If multiple chords contain an equivalent type/gender the method can including selecting a chord with an equivalent type/gender that has a root note a least number of half steps away from the user input root note 404. In a third example, picking a closest related chord includes selecting a chord with an equivalent type/gender and extension as user input type/gender 406 and user input extension 408.

Once a closest related chord has been picked 412 from a limited chord database 414, the method can proceed to step 416 where transposition rules are applied. In one example, the application of transposition rules includes shifting all notes in a chord, chord with an associated pattern, etc. by a defined number of half steps. For example, if a closest related chord has a root note of G and a user has input a desired root note of A, the notes in the closest related chord are shifted up by two half steps. In a second example, if a closest related chord has a root note of Bb and a user has input a desired root note of Ab, the notes in the closest related chord are shifted down by two half steps. In a third example, if a closest related chord has a root note of C and a user has input a desired root note of Eb, the notes in the closest related chord are shifted down up by three half steps. These examples are merely illustrative and those of skill in the art can recognize other transpositions that can be used.

Once transposition rules have been applied in step 416, the method can proceed to step 418 applying extension rules. As shown, 12 half steps exist in an octave of notes. As one example, if a major $7^{th}$ extension is applied to a major chord, a note in the $12^{th}$ half step position is added to the chord. In another example, if a dominant $7^{th}$ extension is applied to a major or minor chord, a note in the $11^{th}$ half step position is added to the chord. In a third example, a major $7^{th}$ extension can be modified to a dominant 7 extension by deactivating the note in the $12^{th}$ half step and activating the note in the $11^{th}$ half step. These examples are merely illustrative and those of skill in the art will recognize other similar methods for applying or modifying an extension according to the disclosed technologies.

Once any extension rules have been applied in step 418, the method can proceed to step 420 applying alternate bass rules. In one example, 12 half steps exist in an octave of notes. In this example, the processor will add a note that corresponds to received input alternate bass note. For example, if a user selects a C major chord with an alternate bass note of D (sometimes written as C/D), a processor can activate the $1^{st}$, $5^{th}$, and $8^{th}$ tones of the 12 half steps in the key of C to generate a C major chord, and also activate the $3^{rd}$ tone of the 12 half steps to add an alternate bass of D.

Once any alternate bass rules have been applied in step 420, the method can proceed to step 422 and output a custom chord. The processor 120 can then cause the output custom chord to be stored in memory 130 and cause the custom chord to be output to a speaker upon receiving a user input.

Figure 5:
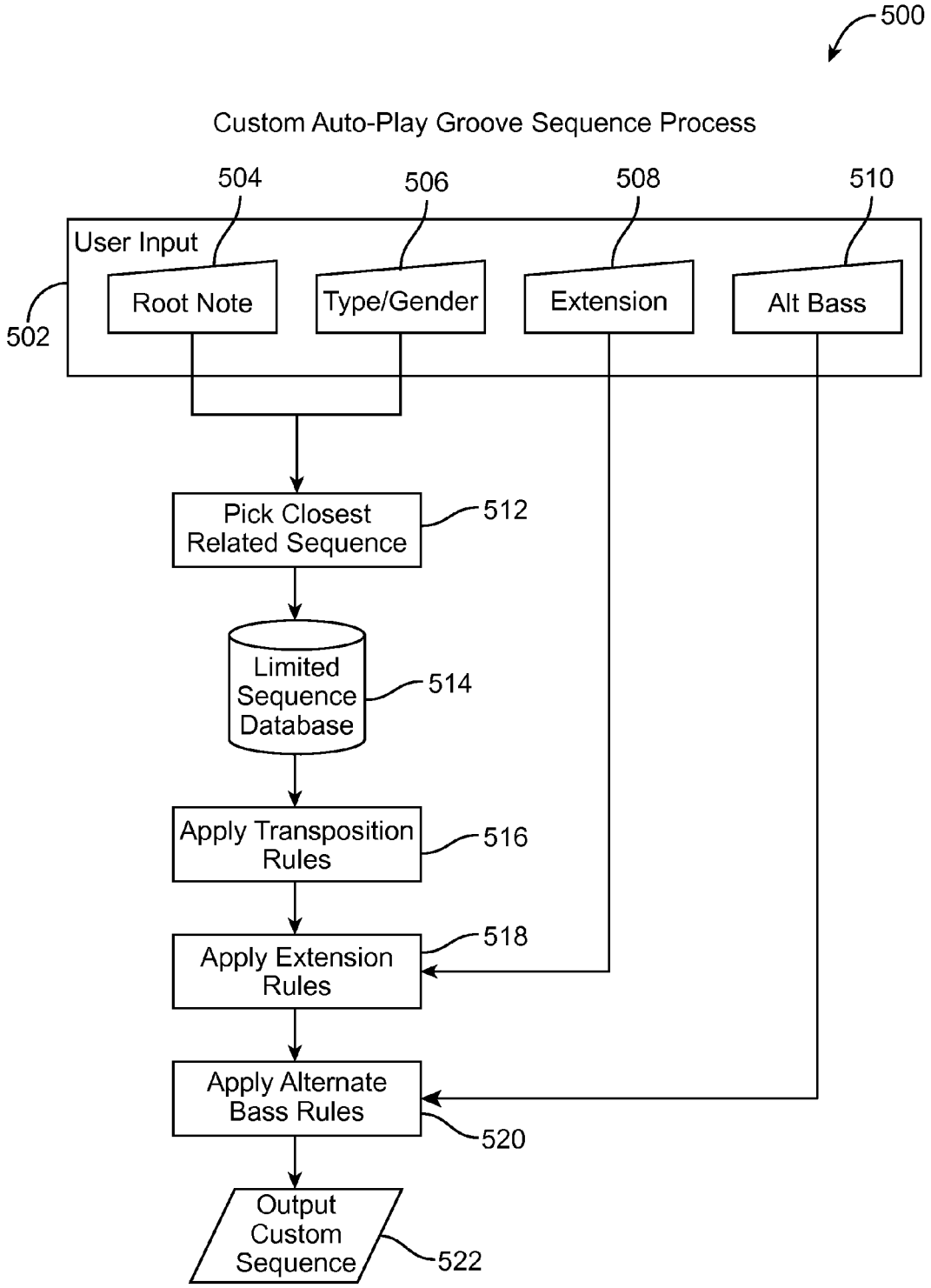
FIG. 5 illustrates a method for generating a customized chord and associated pattern based on limited chords available in a database.

FIG. 5 illustrates a method 500 for generating a customized chord and associated pattern based on limited chords available in a database. The method of FIG. 5 begins at step 502, which accepts a user input. The user input 502 can include up to four pieces of information including root note 504, type/gender 506, extension 508, and alternate bass 510. Although an input with four fields is displayed, a user input with less than four inputs can be acceptable for the method to proceed past step 502 for generating a custom chord and associated pattern. The steps shown in FIG. 5 are only illustrative as one example, and the sequence of steps and steps required to generate a customized chord and associated pattern can vary.

Once a user input in step 502 is received, the method can proceed to step 512, which includes picking a closest related sequence in a limited sequence database 514. In one example, picking a closest related sequence can include selecting a sequence with a root note that is a least number of half steps away from the user input root note 504. In a second example, picking a closest related sequence can include selecting a sequence with an equivalent type/gender as user input type/gender 506. If multiple sequences contain an equivalent type/gender the method can including selecting a sequence with an equivalent type/gender that has a root note a least number of half steps away from the user input root note 504. In a third example, picking a closest related sequence includes selecting a sequence with an equivalent type/gender and extension as user input type/gender 506 and user input extension 508.

Once a closest related sequence has been picked 512 from a limited sequence database 514, the method can proceed to step 516 where transposition rules are applied. In one example, the application of transposition rules includes shifting all notes in a sequence by a defined number of half steps. For example, if a closest related sequence has a root note of G and a user has input a desired root note of A, the notes in the closest related sequence are shifted up by two half steps. This example is merely illustrative and those of skill in the art can recognize other transpositions.

Once transposition rules have been applied in step 516, the method can proceed to step 518 applying extension rules. As illustrated, 12 half steps exist in an octave of notes. As one example, if a major $7^{th}$ extension is applied to a major sequence, notes in the $12^{th}$ half step position are added to the sequence. In another example, if a dominant $7^{th}$ extension is applied to a major or minor sequence, notes in the $11^{th}$ half step position are added to the sequence. In a third example, a major $7^{th}$ extension can be modified to a dominant 7 extension by moving the notes in the $12^{th}$ half step position to the $11^{th}$ half step position. In another example, if a sequence of notes contains notes in the $2^{nd}$ half step position and rules for a $9^{th}$ chord extension are applied, notes on the $2^{nd}$ half step position are muted to prevent harmonic clashes. These examples are merely illustrative and those of skill in the art will recognize other similar methods for applying or modifying an extension according to the disclosed technologies.

Once any extension rules have been applied in step 518, the method can proceed to step 520 applying alternate bass rules. As shown, 12 half steps exist in an octave of notes. In this example, the processor 120 will add a note that corresponds to received input alternate bass note 510. For example, if a user selects a C major chord with an alternate bass note of D (sometimes written as C/D), a processor can activate the $1^{st}$, $5^{th}$, and $8^{th}$ tones of the 12 half steps in the key of C to generate a C major sequence, and also activate the $3^{rd}$ tone of the 12 half steps to add an alternate bass of D in the sequence. This added alternate bass note can have an additional rule applied to transpose the octave of the alternate bass note to assure that it is the lowest note of the sequence or chord.

Once any alternate bass rules have been applied in step 520, the method can proceed to step 522 and output a custom sequence. The processor 120 can then cause the output custom sequence to be stored in memory 130 and cause the custom sequence to be output to a speaker upon receiving a user input.

Figure 6:
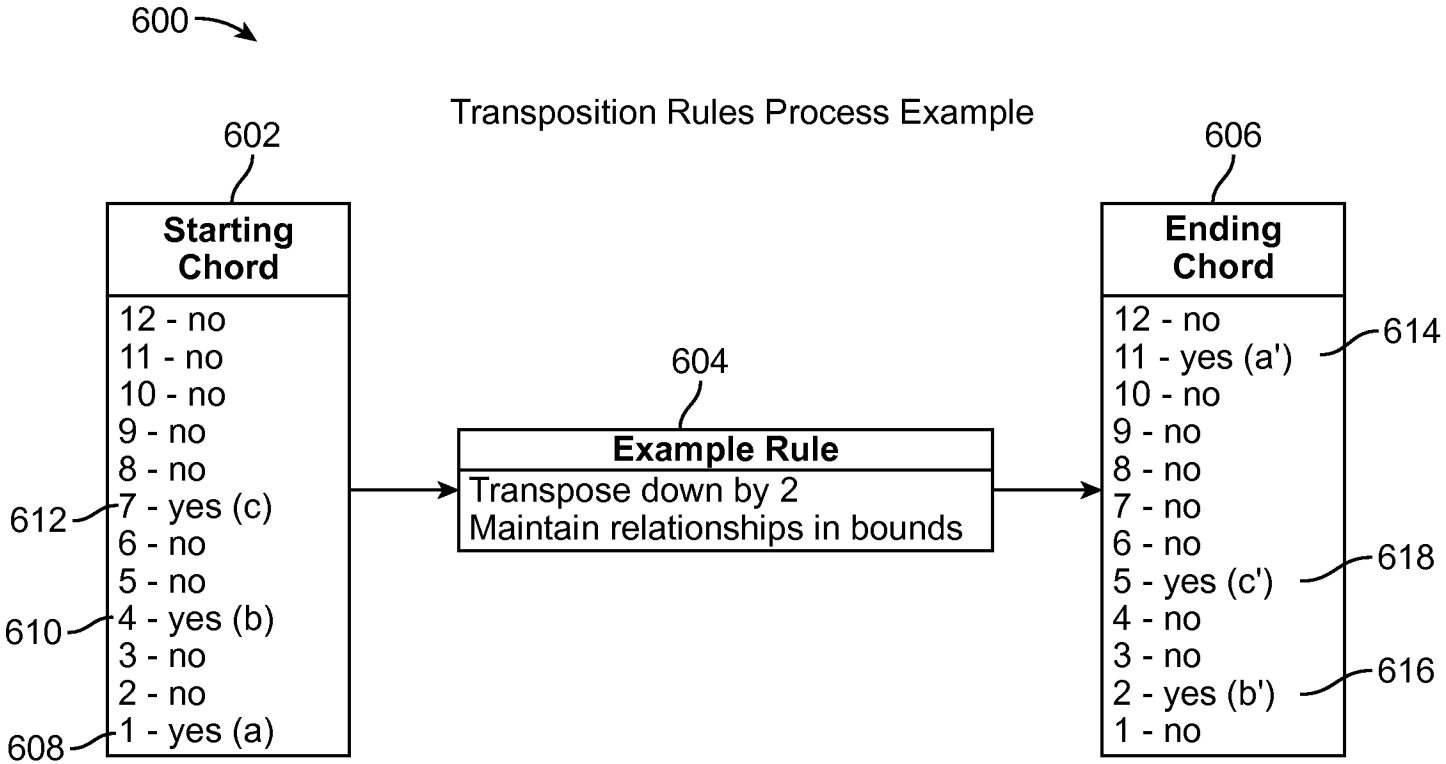
FIG. 6 illustrates a method for modifying an existing chord to a user customized chord.

FIG. 6 illustrates a method 600 for modifying an existing chord to a user-customized chord. The method of FIG. 6 begins at step 602 with a starting chord. In this example, in an octave with 12 halfnotes, the first, fourth, and seventh half notes are activated to form the starting chord. The method can then proceed to step 604 where an example rule is applied. In this example, the processor 120 has identified a starting chord in a limited database that is 2 half steps higher than a customized chord user input. Therefore, processor 120 applies a rule that transposes the starting chord down by two and that maintains any relationships within specified bounds.

Once example rule 604 has been applied to starting chord 602, the method can proceed to step 606 and generate an ending chord and shown. In the ending chord, the second, fifth, and eleventh half notes are activated. A first note (a) is shifted down by two steps, while the relationship is maintained in bounds. In this example, when first note (a) was shifted down one step from position 608 it moved to the $12^{th}$ half step note position. When the first note (a) was shifted further down one step it moved to the $11^{th}$ half step position 614. When second note (b) was transposed from position 610, it moved to the $2^{nd}$ half note position 616. When third note (c) was transposed from position 612, it moved to the $5^{th}$ half note position 618. Although in this example the illustrated rule transposes downward and maintains a relationship within a bound of 12 half steps, other rules and bounds can be implemented.

Figure 7:
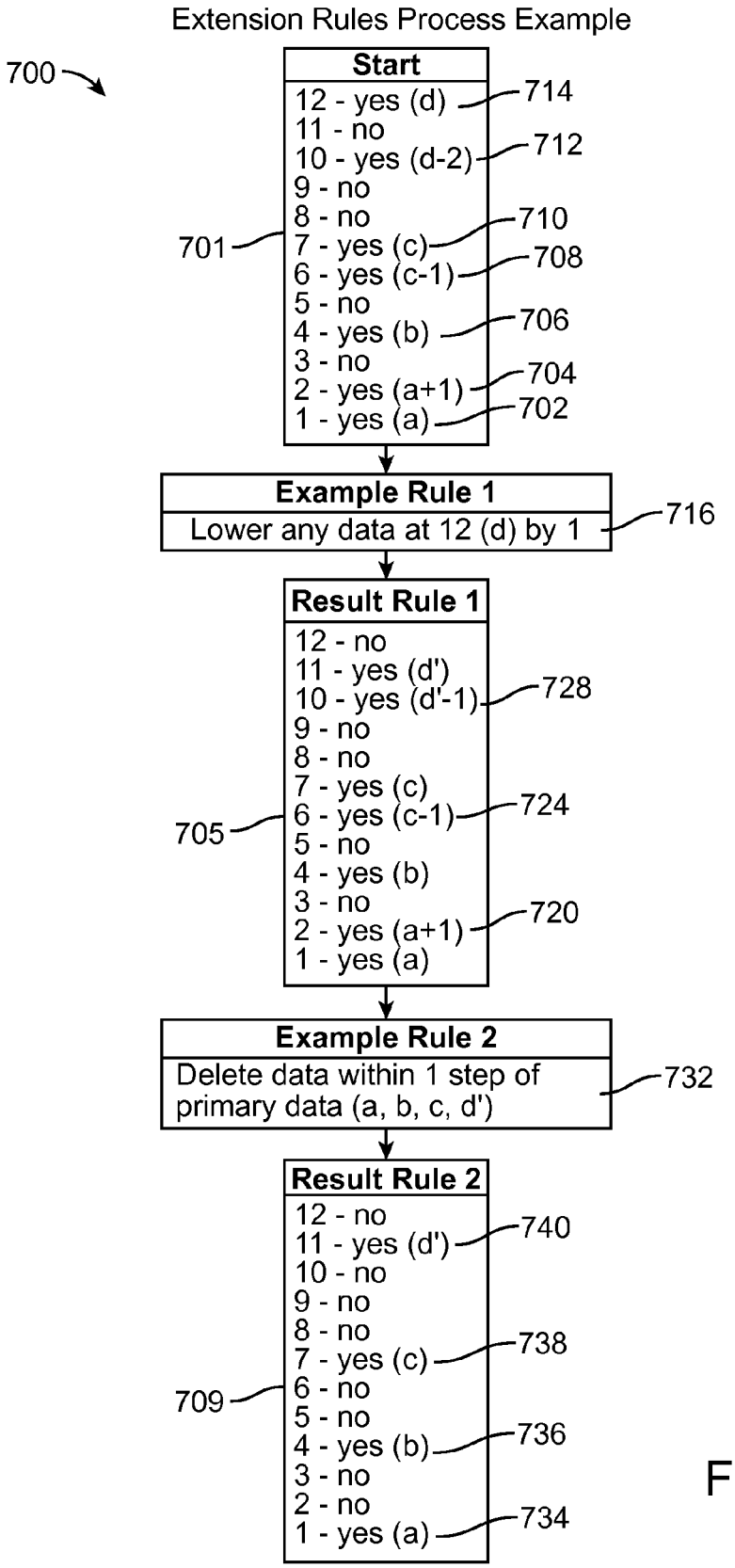
FIG. 7 illustrates a method for modifying an existing pattern to a user customized pattern.

FIG. 7 illustrates a method 700 for modifying an existing pattern to a user-customized pattern. FIG. 7 begins with a starting pattern 701. The displayed starting pattern includes a first primary note (a) at a first half step position 702, second primary note (b) at a fourth half step position 706, third primary note (c) at a seventh half step position 710, and fourth primary note (d) at a twelfth half step position 714. The displayed starting pattern also includes a first secondary note (a+1) at a second half step position 704, second secondary note (c−1) at a sixth half step position 708, and third secondary note (d−2) at a tenth half step position 712. A processor 120 can then apply rule 716 to the pattern 701. Rule 716 lowers any data at a twelfth half step position by one step. The result of applying rule 716 is shown in pattern 705. All notes remain the same except that note (d) moved from the twelfth half note position to the eleventh half note position. This example rule 716 acts to change a major $7^{th}$ extension to a dominant $7^{th}$ extension. This is an illustrative example and other rules can be utilized. For example, a rule raising a note at an eleventh half note position to a twelfth half note position will operate to convert a dominant $7^{th}$ extension to a major $7^{th}$ extension.

In FIG. 7, a second example rule 732 is applied to the resulting pattern 705. Second example rule deletes any data within 1 step of any primary data (a) 734, (b) 736, (c) 738, and (d') 740. This causes the deletion of notes at the $10^{th}$ half step position 728, $6^{th}$ half step position 724, and $2^{nd}$ half step position 720. The resulting pattern 709 contains a first note 734 at the first half note position, a second note 736 at the fourth half note position, a third note 738 at the seventh half note position, and a fourth note 740 at the eleventh half note position. In this example, rule 732 can operate to remove notes that would clash and provide unpleasing acoustic results to a user.

Figure 8:
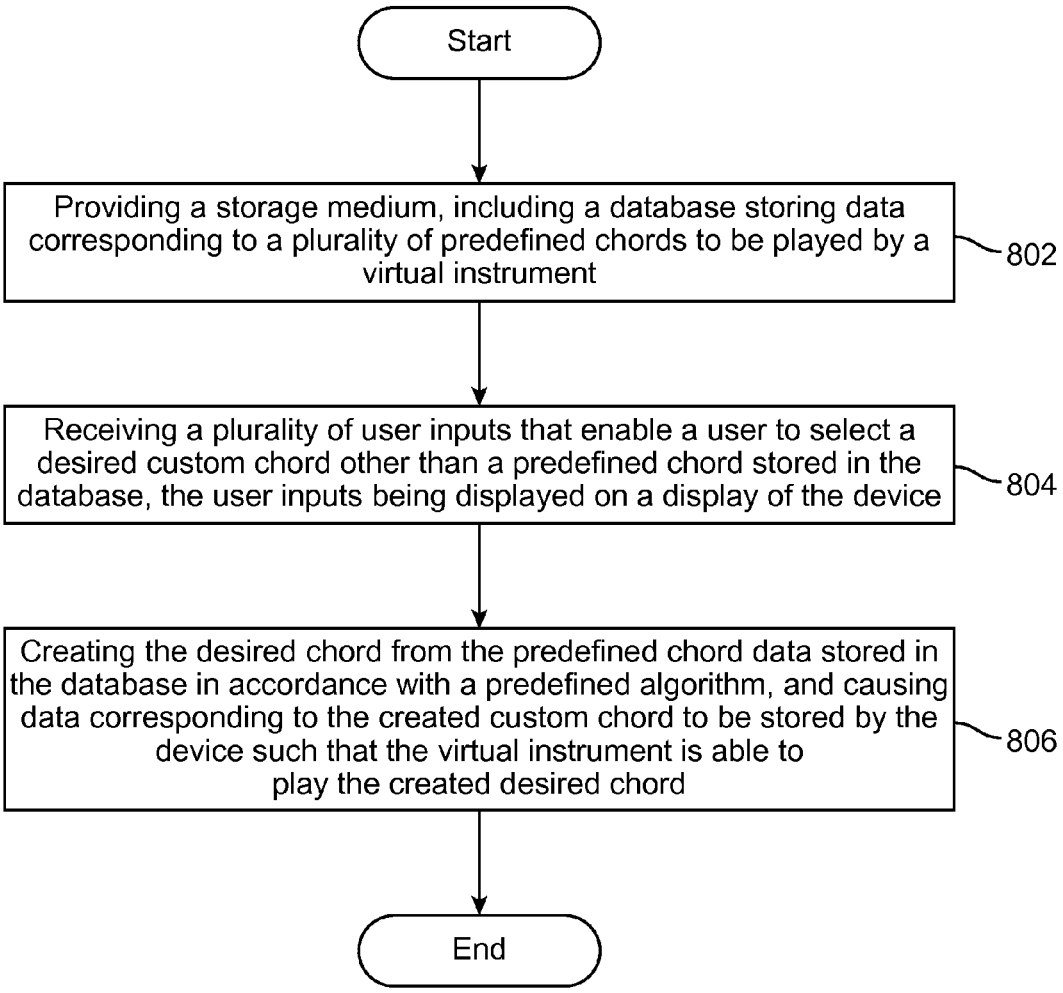
FIG. 8 illustrates an example method embodiment.

Having disclosed some basic system components and concepts, the disclosure now turns to the exemplary method embodiment shown in FIG. 8. For the sake of clarity, the method is discussed in terms of an exemplary system 100 as shown in FIG. 1 configured to practice the method. The steps outlined herein are exemplary and can be implemented in any combination thereof, including combinations that exclude, add, or modify certain steps.

The method includes 802 providing a storage medium 160, including a database storing data corresponding to a plurality of predefined chords to be played by a virtual instrument. The method then includes 804 receiving a plurality of user inputs 190 that enable a user to select a desired custom chord other than a predefined chord stored in the database, the user inputs being displayed on a display of the device. The method then includes 806 creating the desired chord from the predefined chord data stored in the database in accordance with a predefined algorithm, and causing data corresponding to the created custom chord to be stored by the device such that the virtual instrument is able to play 170 the created desired chord. In one example, the plurality of user inputs can include a root note input, and a chord gender input. In another example, the plurality of user inputs can further include a chord extension input. In another example, the plurality of user inputs can further include an alternate bass note input.

In one example, a user selectable icon representing the created custom chord is displayed on the display. In a further example, the custom chord icon replaces one of a plurality of default icons displayed on the display, each respectively representing one of the predefined chords. The data corresponding to the custom chord can be a MIDI file.

The creating step 806 can further include, in response to at least the root note user input and the chord gender user input, selecting from the database a stored predefined chord having a set of notes closest to the user selected custom chord, wherein the selected predefined chord data is used to create the custom chord. The creating step 806 can further include instructions for transposing predetermined notes in the selected predefined chord data in accordance with a predefined algorithm so as to create the custom chord. The creating step 806 can further include, in response to at least the root note user input, the chord gender user input, and the chord extension user input, selecting from the database a stored predefined chord having a set of notes closest to the user selected custom chord, wherein the selected predefined chord data is used to create the custom chord. The creating step 806 can further include transposing predetermined notes in the selected predefined chord data in accordance with a predefined algorithm so as to create the custom chord.

The creating step 806 can also include instructions for transposing or adding predetermined notes in the user selected alternate bass note in accordance with a predefined algorithm so as to create a custom chord with an alternate bass note. The creating step 806 can further include, in response to a created custom chord, modifying notes in a stored predefined rhythmic pattern file in the database in accordance with a predefined algorithm, to create a modified rhythmic pattern that is consistent with notes of the created custom chord.

A graphical programming interface system for a virtual musical instrument is also disclosed. The system is described in reference to FIG. 1. The system can include a display 170 and a processor 120. The system can include a storage medium 160, including a database storing data corresponding to a plurality of predefined chords to be played by the virtual instrument. The system can also include a plurality of user inputs 190 that enable a user to select a desired custom chord other than a predefined chord stored in the database 160, the user inputs being displayed on the display 170. The system can further include a set of processor-executable instructions 162 stored in the storage medium 160, the instructions being responsive to specific inputs entered by a user to create the desired chord from the predefined chord data stored in the database in accordance with a predefined algorithm, and to cause data corresponding to the created custom chord to be stored by the system such that the virtual instrument is able to play the created desired chord. In one example, the plurality of user inputs can include a root note input, and a chord gender input. In another example, the plurality of user inputs can further include a chord extension input. The plurality of user inputs can also include an alternate bass note input. In one example, the system can include an embodiment wherein a user selectable icon representing the created custom chord is displayed on the display 170. In another embodiment of the system, the custom chord icon replaces one of a plurality of default icons displayed on the display 170, each respectively representing one of said predefined chords. The data corresponding to the custom chord can be a MIDI file.

The set of processor-executable instructions 162 can include instructions for, in response to at least the root note user input and the chord gender user input, selecting from the database a stored predefined chord having a set of notes closest to the user selected custom chord, wherein the selected predefined chord data is used to create the custom chord. The set of processor-executable instructions 162 can further include instructions for transposing predetermined notes in the selected predefined chord data in accordance with a predefined algorithm so as to create the custom chord. The set of processor-executable instructions 162 can also include instructions for, in response to at least the root note user input, the chord gender user input, and the chord extension user input, selecting from the database a stored predefined chord having a set of notes closest to the user selected custom chord, wherein the selected predefined chord data is used to create the custom chord.

The set of processor-executable instructions 162 can further include instructions for transposing predetermined notes in the selected predefined chord data in accordance with a predefined algorithm so as to create the custom chord. The set of processor-executable instructions 162 can further includes instructions for transposing or adding predetermined notes in the user selected alternate bass note in accordance with a predefined algorithm so as to create a custom chord with an alternate bass note. The set of processor-executable instructions 162 can further include instructions for, in response to a created custom chord, modifying notes in a stored predefined rhythmic pattern file in the database in accordance with a predefined algorithm, to create a modified rhythmic pattern that is consistent with notes of the created custom chord.

In a further example of the system, the user inputs can be selectable by a user using a device such as a keyboard, mouse, or touch-sensitive mechanism on the display 170, 190.

A computer program product is also disclosed. The product includes a non-transitory computer readable storage medium storing a plurality of computer-executable instructions 164 for editing prestored chords of a virtual musical instrument embodied in an electronic processing device. The instructions 164 can include providing a storage medium, including a database storing data corresponding to a plurality of predefined chords to be played by the virtual instrument. The instructions 164 can further include receiving a plurality of user inputs that enable a user to select a desired custom chord other than a predefined chord stored in the database, the user inputs being displayed on a display of the device. The instructions 164 can also include creating the desired chord from the predefined chord data stored in the database in accordance with a predefined algorithm, and causing data corresponding to the created custom chord to be stored by the device such that the virtual instrument is able to play the created desired chord.

The plurality of user inputs can include a root note input, and a chord gender input. The plurality of user inputs can further include a chord extension input. In another example, the plurality of user inputs can include an alternate bass note input.

In one example, a user selectable icon representing the created custom chord is displayed on the display. In another example, the custom chord icon replaces one of a plurality of default icons displayed on the display, each respectively representing one of the predefined chords. The data corresponding to the custom chord can be a MIDI file.

The computer program product can include instructions for, in response to at least the root note user input and the chord gender user input, selecting from the database a stored predefined chord having a set of notes closest to the user selected custom chord, wherein the selected predefined chord data is used to create the custom chord.

The computer program product can include instructions for transposing predetermined notes in the selected predefined chord data in accordance with a predefined algorithm so as to create the custom chord. The computer program product can also include instructions for, in response to at least the root note user input, the chord gender user input, and the chord extension user input, selecting from the database a stored predefined chord having a set of notes closest to the user selected custom chord, wherein the selected predefined chord data is used to create the custom chord. The computer program product can also include instructions for transposing predetermined notes in the selected predefined chord data in accordance with a predefined algorithm so as to create the custom chord. The computer program product can also include instructions for transposing or adding predetermined notes in the user selected alternate bass note in accordance with a predefined algorithm so as to create a custom chord with an alternate bass note.

The computer program product can also include instructions for, in response to a created custom chord, modifying notes in a stored predefined rhythmic pattern file in the database in accordance with a predefined algorithm, to create a modified rhythmic pattern that is consistent with notes of the created custom chord.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

We claim:

1. A computer-implemented method, comprising:

storing, on a computing device, audio data including a predetermined chord, the predetermined chord including two or more notes;

associating the predetermined chord with a chord touch region on a touch-sensitive display;

receiving input corresponding to a selection of the chord touch region;

receiving a plurality of user inputs defining a chord, the plurality of user inputs corresponding to a selection of chord attributes associated with the selected chord touch region, wherein chord attributes include a root note and a chord type, and wherein each chord attribute is individually selectable; and modifying the predetermined chord using the selected chord attributes.

2. The method of claim 1, wherein the plurality of user inputs further includes a chord extension, wherein the chord extension is a chord attribute.

3. The method of claim 1, wherein the plurality of user inputs further includes a bass note, wherein the bass note is a chord attribute.

4. The method of claim 3, wherein the modified predetermined chord includes notes, and wherein the bass note is an alternating bass note that includes the notes of the modified predetermined chord.

5. The method of claim 1, further comprising:

receiving input corresponding to a selection of a key; and transposing the modified chord using the selected key.

6. The method of claim 1, further comprising:

playing the modified predetermined chord according to a predefined rhythmic pattern.

7. The method of claim 1, wherein selecting the chord touch region and the chord attribute includes receiving a microphone input.

8. The method of claim 1 wherein each chord attribute is individually selectable on a separate graphical attribute selection interface.

9. A computer-implemented system, comprising:

one or more data processors;

one or more non-transitory computer-readable storage media containing instructions configured to cause the one or more processors to perform operations including:

storing audio data including a predetermined chord, the predetermined chord including two or more notes;

associating the predetermined chord with a chord touch region on a touch-sensitive display;

receiving input corresponding to a selection of the chord touch region;

receiving a plurality of user inputs defining a chord, the plurality of user inputs corresponding to a selection of chord attribute associated with the selected chord touch region, wherein chord attributes include a root note and a chord type, and wherein each chord attribute is individually selectable; and modifying the predetermined chord using the selected chord attributes.

10. The system of claim 9, wherein the plurality of user inputs further includes a chord extension, wherein the chord extension is a chord attribute.

11. The system of claim 9, wherein the plurality of user inputs further includes a bass note, wherein the bass note is a chord attribute.

12. The system of claim 11 wherein the modified predetermined chord includes notes, and wherein the bass note is an alternating bass note that includes the notes of the modified predetermined chord.

13. The system of claim 9, further comprising instructions configured to cause the one or more processors to perform operations including:

receiving input corresponding to a selection of a key; and transposing the modified chord using the selected key.

14. The system of claim 9, further comprising instructions configured to cause the one or more processors to perform operations including:

playing the modified predetermined chord according to a predefined rhythmic pattern.

15. The system of claim 9 wherein selecting the chord touch region and the chord attribute includes receiving a microphone input.

16. A computer-program product, tangibly embodied in a non-transitory machine-readable storage medium, including instructions configured to cause a data processing system to:

store audio data including a predetermined chord, the predetermined chord including two or more notes;

associate the predetermined chord with a chord touch region on a touch-sensitive display, receive input corresponding to a selection of the chord touch region;

receive a plurality of user inputs defining a chord, the plurality of user inputs corresponding to a selection of chord attributes associated with the selected chord touch region, wherein chord attributes include a root note and a chord type, and wherein each chord attribute is individually selectable; and modify the predetermined chord using the selected chord attributes.

17. The computer program product of claim 16, wherein the plurality of user inputs further includes a chord extension, wherein the chord extension is a chord attribute.

18. The computer program product of claim 16, wherein the plurality of user inputs further includes a bass note, wherein the bass note is a chord attribute.

19. The computer program product of claim 18, wherein the modified predetermined chord includes notes, and wherein the bass note is an alternating bass note that includes notes of the modified predetermined chord.

20. The computer program product of claim 16, further comprising instructions configured to cause a data processing system to:

receive input corresponding to a selection of a key; and transpose the modified chord using the selected key.

21. The computer program product of claim 16, further comprising instructions configured to cause a data processing system to:

play the modified predetermined chord according to a predefined rhythmic pattern.

22. The computer program product of claim 16, wherein selecting the chord touch region and the chord attribute includes receiving a microphone input.

* * * * *

UNITED STATES PATENT AND TRADEMARK OFFICE

CERTIFICATE OF CORRECTION

PATENT NO. : 8,614,388 B2
APPLICATION NO. : 13/286145
DATED : December 24, 2013
INVENTOR(S) : Alexander Harry Little and Eli T. Manjarrez It is certified that error appears in the above-identified patent and that said Letters Patent is hereby corrected as shown below:

In the claims

Column 12, Line 42, Claim 9: please delete “attribute” and insert --attributes--.

Signed and Sealed this
Fourth Day of March, 2014

Michelle K. Lee

Michelle K. Lee
*Deputy Director of the United States Patent and Trademark Office*